US006232878B1

(12) United States Patent
Rubin

(10) Patent No.: US 6,232,878 B1
(45) Date of Patent: May 15, 2001

(54) RESONANT CIRCUIT DETECTION, MEASUREMENT AND DEACTIVATION SYSTEM EMPLOYING A NUMERICALLY CONTROLLED OSCILLATOR

(75) Inventor: Stuart Rubin, Philadelphia, PA (US)

(73) Assignee: Checkpoint Systems, Inc., Thorofare, NJ (US)

( * ) Notice: Subject to any disclaimer, the term of this patent is extended or adjusted under 35 U.S.C. 154(b) by 0 days.

(21) Appl. No.: 09/315,452

(22) Filed: May 20, 1999

(51) Int. Cl.[7] ..... G08B 13/14
(52) U.S. Cl. ..... 340/572.1; 340/572.5
(58) Field of Search ..... 340/572.1, 572.2, 340/572.3, 572.4, 572.5, 568.1, 571

(56) References Cited

U.S. PATENT DOCUMENTS 4,021,705 5/1977 Lichtblau .
4,567,473 1/1986 Lichtblau .
4,609,911 * 9/1986 Nourse et al. ..... 340/572.1
4,859,991 * 8/1989 Watkins et al. ..... 340/572.1
5,019,815 * 5/1991 Lemelson et al. ..... 340/572.1
5,103,210 * 4/1992 Rode et al. ..... 340/572.1
5,353,011 * 10/1994 Wheeler et al. ..... 340/572.1

* cited by examiner

*Primary Examiner*—Nina Tong
(74) *Attorney, Agent, or Firm*—Akin, Gump, Strauss, Hauer & Feld, L.L.P.

(57) ABSTRACT

An apparatus for measuring electrical characteristics of a resonant circuit without physically contacting the resonant circuit. The EAS system includes a numerically controlled oscillator for generating an alternating electric signal, the frequency of the alternating electric signal varying in accordance with a numerical frequency control signal; a transmitting antenna connected to the numerically controlled oscillator for establishing an electromagnetic field within a measurement zone; a receiving antenna for sensing disturbances to the electromagnetic field within the measurement zone; a receiver for receiving signals from the receiving antenna representative of disturbances to the electromagnetic field and for determining the Q and center frequency of the resonant circuit; and a clock having a substantially fixed frequency connected to the numerically controlled oscillator. The frequency of the alternating electric signal is restricted to being an integer multiple of an integer sub-multiple of the clock frequency.

18 Claims, 3 Drawing Sheets

RESONANT CIRCUIT DETECTION, MEASUREMENT AND DEACTIVATION SYSTEM EMPLOYING A NUMERICALLY CONTROLLED OSCILLATOR

BACKGROUND OF THE INVENTION

The present invention relates generally to electronic article security (EAS) systems and more particularly to an improved numerically controlled oscillator for controlling the operating frequency of an EAS system.

In general, EAS systems are used for detecting and preventing theft or unauthorized removal of articles which are readily accessible to potential customers or facility users and are susceptible to unauthorized removal. Such EAS systems generally employ a security tag which is secured to or associated with an article or it's packaging. The EAS systems detect the presence (or absence) of the security tag, and thus the presence or absence of a protected article, within a detection zone. Typically, the detection zone is located at or around an exit or entrance to the facility or a portion of the facility.

One type of EAS system which has gained widespread popularity utilizes a security tag which includes a self-contained resonant circuit in the form of a small, generally planar printed circuit which resonates at a predetermined detection frequency within a detection frequency range. A transmitter which is tuned to the detection frequency is employed for transmitting electromagnetic energy into the detection zone. A receiver, also tuned to the detection frequency, is positioned proximate to the detection zone. When an article having an attached security tag passes into or through the detection zone, the security tag is exposed to the transmitted electromagnetic energy resulting in the resonant circuit resonating to provide an output signal detectable by the receiver. The detection of such an output signal by the receiver indicates the presence of an article with an attached security tag within the detection zone and the receiver actuates an alarm to alert appropriate security or other personnel.

EAS systems of the type described above employ a transmitter to provide a radio frequency (RF) output signal to a transmit antenna. In one kind of generally employed EAS system the frequency of the output signal is swept up and down at a predetermined sweep rate within a predetermined frequency range generally surrounding the resonant frequency of the tags employed. Typically, the output frequency is swept between a low frequency of 7.2 MHz. and a high frequency of 9.2 MHz. and thus has a bandwidth of 2.0 MHz. and a center frequency of 8.2 MHz. Security tags typically employed with the EAS system have a resonant frequency of 8.2 MHz. but may vary upwardly or downwardly due to a variety of factors including manufacturing tolerance, environmental conditions, etc. By sweeping through a band on both sides of the tag nominal resonant frequency, the EAS system compensates for such tag variations and is able to reliably detect a high percentage of all security tags.

In use, the EAS system transmitter emits the swept frequency into the detection zone from the transmit antenna. The emitted RF signal is received by a receive antenna and is demodulated by the EAS receiver. Where no security tag is present in the detection zone, the receiver detects a known pattern. The presence of a resonant security tag in the detection zone causes the received pattern to deviate from the known pattern in recognized ways resulting in the generation of an alarm as described above.

Security tags are made in high volume and require rapid individual testing to ensure that they will respond properly to EAS systems when attached to a protected article. Security tags having a resonant frequency outside predetermined limits or having a resonance with insufficient Q are normally rejected by the testing process. In this case, quantitative measurements of the security tag resonant frequency and indications representative of the tag Q are required to be performed at high speed. EAS systems adapted to testing are preferable for performing the tag measurements because the tag characteristics can be measured without contacting the individual tags.

Current EAS system transmitters typically use voltage controlled oscillators (VCOs) employing varactor diodes as variable capacitor elements to enable the frequency of the voltage controlled oscillator to be swept between the low and high limits. The nature of varactor diodes results in instability of the frequency of the voltage controlled oscillator output signal and also results in a non-linear frequency sweep characteristic. From a security tag testing perspective, the frequency instability of the transmitted signal adds uncertainty in measuring the resonant frequency of the tag being tested. From an EAS system operating perspective, VCO instability requires the EAS transmitter to sweep over an even larger bandwidth to compensate for the VCO instability or alternatively, forces narrower production limits on the tag resonant frequency. In the former case, the frequency instability of the transmitted signal reduces the reliability of tag detection since the acceptance limits of the received signal must be made larger. In the latter case, narrower production limits on tag resonant frequency increases the tag reject rate and thus costs. Also, the non-linear sweep characteristic of the frequency sweep has undesired effects, principally in reducing the probability of detection, increasing the false alarm rate and increasing the out-of-band emissions.

The availability of high volume large scale integrated (LSI) circuits has made it economically feasible to employ direct digital synthesis devices in EAS systems in place of varactor tuned voltage controlled oscillators. The direct digital synthesis device, when controlled from a high stability clock such as a crystal oscillator, substantially eliminates frequency drift and the attendant detection losses due to frequency drift. In addition, the use of a direct digital synthesis device in EAS systems allows for the generation of a wide variety of accurately controlled frequency patterns, which could include arbitrary frequency patterns such as pseudo random patterns in addition to the linear and sinusoidal frequency sweep patterns typically used in EAS systems, with potential improvement in the probability of detection, reduced false alarm rate and reduced out-of-band emissions.

BRIEF SUMMARY OF THE INVENTION

Briefly stated the present invention comprises an apparatus for measuring electrical characteristics of a resonant circuit without physically contacting the resonant circuit. The apparatus includes a numerically controlled oscillator for generating an alternating electric signal, the frequency of the alternating electric signal varying in accordance with a numerical frequency control signal; a transmitting. antenna connected to the numerically controlled oscillator for establishing an electromagnetic field within a measurement zone; a receiving antenna for sensing disturbances to the electromagnetic field within the measurement zone; a receiver for receiving signals from the receiving antenna representative of disturbances to the electromagnetic field and for determining the Q and center frequency of the resonant circuit; and a clock having a substantially fixed frequency connected to the numerically controlled oscillator wherein the frequency of the alternating electric signal is restricted to being an integer multiple of an integer sub-multiple of the clock frequency.

Another embodiment of the present invention comprises an electronic article security (EAS) system for detecting the presence of a security tag in a detection zone. The EAS system includes a numerically controlled oscillator for generating an alternating electric signal, the frequency of the alternating electric signal varying in accordance with a numerical frequency control signal; a transmitting antenna connected to the numerically controlled oscillator for establishing an electromagnetic field within the detection zone; a receiving antenna for sensing disturbances to the electromagnetic field within the detection zone; a receiver for receiving signals from the receiving antenna representative of disturbances to the electromagnetic field and for determining the presence of a security tag in the detection zone; and a clock having a substantially fixed frequency connected to the numerically controlled oscillator wherein the frequency of the alternating electric signal is restricted to being an integer multiple of an integer sub-multiple of the clock frequency.

Another embodiment of the present invention comprises an apparatus for deactivating a security tag in a deactivation zone. The apparatus includes a numerically controlled oscillator for generating a first alternating electric signal, the frequency of the first alternating electric signal varying in accordance with a numerical frequency control signal; a clock having a substantially fixed frequency connected to the numerically controlled oscillator, the frequency of the first alternating electric signal being restricted to an integer multiple of an integer sub-multiple of the frequency of the clock; and a transmitting antenna connected to the numerically controlled oscillator for receiving the first alternating electric signal and establishing a first electromagnetic field within the deactivation zone wherein the first electromagnetic field interacts with the security tag to deactivate the security tag.

BRIEF DESCRIPTION OF THE SEVERAL VIEWS OF THE DRAWINGS

The foregoing summary, as well as the following detailed description of the preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
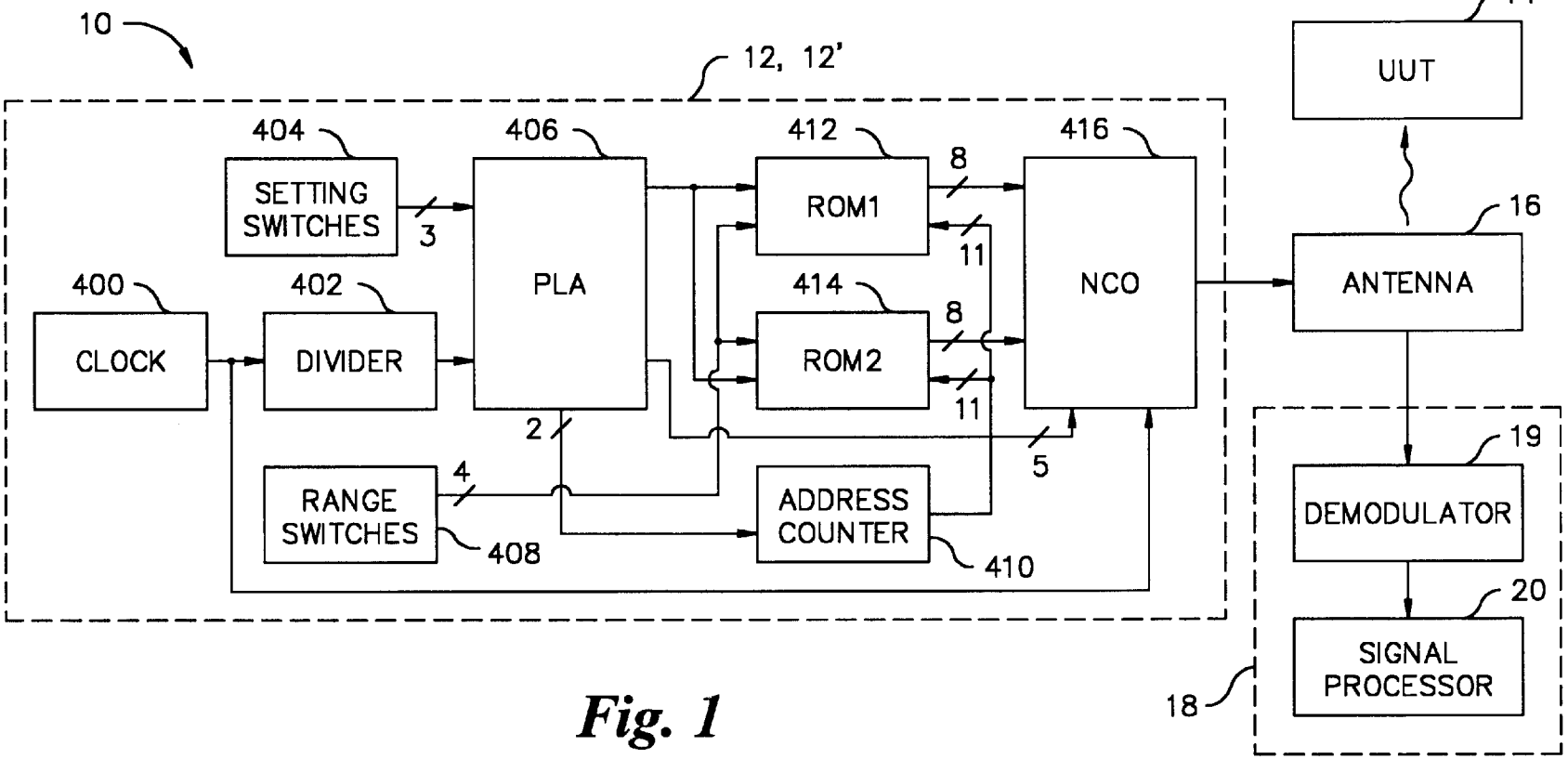
FIG. 1 is a functional block diagram of an apparatus for measuring the electrical characteristics of a resonant circuit in accordance with the first embodiment of the present invention.

In the drawings, like numerals are used to indicate like elements throughout. Referring now to FIG. 1 there shown a block diagram of a first preferred embodiment of a test system 10, configured for measuring the electrical characteristics of a resonant circuit or resonant security tag 14 as a unit under test (UUT). The test system 10 comprises a transmitter 12 for generating an alternating electrical signal, a transmitting and receiving antenna 16 for emitting electromagnetic energy in response to the alternating electrical signal received from the transmitter 12, to establish an electromagnetic field within a measurement zone and for sensing disturbances within the measurement zone resulting from the presence of the UUT, and a receiver 18 comprising a demodulator 19 and a signal processor 20 for analyzing signals received from the antenna 16 and for determining the electrical characteristics of the UUT.

In the first preferred embodiment the UUT is a resonant security tag 14 of a type which is well known in the art of electronic article security (EAS) systems and having a resonant frequency within the detection range of the particular EAS system with which the tag 14 is employed. Preferably, the tag 14 resonates at or near 8.2 megahertz, which is a frequency commonly employed by EAS systems from a number of manufacturers. However, the specific resonant frequency is not to be considered a limitation of the present invention. Further, as will be appreciated by those skilled in the art, the test system 10 for measuring the electrical characteristics of a resonant circuit is not limited to testing a resonant security tag 14. Any resonant circuit within the frequency range of the test system 10 which is capable of establishing a suitable mutual inductance between the antenna 16 and the resonant circuit UUT 14 is within the spirit and scope of the invention.

In the first preferred embodiment there is shown a transmitter 12 including a clock 400 for providing timing signals having a fixed frequency to the transmitter components (to be described). In the first preferred embodiment, the clock 400 is a crystal oscillator of a type well known in the art having an output frequency of about 50 MHz. The output signal from the clock 400 is provided directly to a numerically controlled oscillator 416 and a digital divider circuit 402. The digital divider circuit 402 is a 8:1 binary divider integrated circuit of a type well known in the art, and provides an output signal with a stable fixed frequency of 6.25 MHz to the clock input of a programmable logic array (PLA) 406. As will be appreciated by one skilled in the art, the specific frequency of the divider output signal is not critical as long as the frequency of the divider output signal is stable and is compatible with the clock input of the PLA 406.

The PLA 406 provides timing and control signals to a frequency word generator comprising read-only memories ROM1 412 and ROM2 414, an oscillator for generating an alternating signal having a variable frequency comprising the numerically controlled oscillator 416 and an address counter 410.

In the first preferred embodiment, the PLA 406 converts the 6.25 MHz. clock signal applied to the clock input of the PLA 406 to a 390,625 Hz. next frequency pulse signal for clocking the address counter 410. The PLA 406 also establishes a repetition interval by providing a reset pulse to the address counter 410, which resets the address counter 410 to an all zero state once every 2048 next frequency pulses. Thus, the address counter 410 provides a total of 2048 addresses to each of ROM1 412 and ROM2 414 during each repetition interval. The resultant repetition rate is about 190 Hz. One skilled in the art will recognize that the next pulse rate and repetition rate are not fixed and may be set to any rate compatible with the unit under test within the spirit and scope of the invention.

The PLA 406 also provides an output enable signal to ROM1 412 and ROM2 414 for strobing the contents of the address counter 416 into ROM1 412 and ROM2 414. The output enable signal is synchronous with but delayed from the next frequency signal to allow the contents of the address counter 416 to settle before being transferred to ROM1 412 and ROM2 414. PLA 406 also provides a write signal for writing 16 bit wide frequency control signals comprising the contents of ROM1 412 and ROM2 414 into the numerically controlled oscillator 416, a sleep control signal for placing the numerically controlled oscillator 416 into a low power state, a reset signal for setting the current output of the numerically controlled oscillator 416 to midscale and an A1signal for selecting either a FREQ0 or FREQ1 register in the numerically controlled oscillator 416. Also, three setting switches 404 are connected to the PLA 406. The three setting switches 404 are used respectively to cause the PLA 406 to pause, to cause the address counter 406 to reset to its initial state and to cause the numerically controlled oscillator 416 to reset to an initial state.

In the first preferred embodiment each of ROM1 412 and ROM2 414 have 32,768 addressable 8 bit wide storage locations of which 2048 locations are addressable from the address counter 410. In addition, there are four mechanical range switches 408 providing input to the four most significant bits of ROM1 412 and ROM2 414. Manipulation of the range switches 408 allows selection of any one of 16 distinct sets of 2048 addresses within ROM1 412 and ROM2 414 by the address counter 410. Thus, up to 16 distinct frequency patterns may be stored in ROM1 412 and ROM2 414, selectable by the range switches 408.

In the first preferred embodiment a frequency pattern is stored in ROM1 412 and ROM2 414 comprising a uniformly spaced set of positive integers such that the numerically controlled oscillator 416 output frequency sweeps from about 7.2 MHz. to about 9.2 MHz. in a substantially linear stepwise manner over a repetition interval, as the address counter 410 is advanced by application of the next frequency pulse signal to the clock input of the address counter 410. As will be appreciated by one skilled in the art, the frequency patterns stored in ROM1 412 and ROM2 414 are not limited to a linear sweep pattern. For instance, sinusoidal or random patterns could be stored within ROM1 412 and ROM2 414. Also, ROM1 412 and ROM2 414 are not limited to 32,768 memory locations nor is the address counter 410 limited to addressing 2048 memory locations in ROM1 412 and ROM2 414. Further, the number of signals generated by the range switches 408 may be larger or smaller than that provided by the four mechanical switches 408 in the first preferred embodiment and the signals from the range switches 408 may be provided by other means, as for example, by a signal processor 20 or by an external computer, within the spirit and scope of the invention. Additionally, the frequency control words need not be generated by read-only memories. For example, the frequency control words could be generated directly by a computer program executing in a computer or in a programmable logic array within the spirit and scope of the invention.

In the first preferred embodiment, the numerically controlled oscillator 416 is a model AD9830 direct digital synthesizer (DDS) having a phase accumulator, manufactured by Analog Devices, Inc. of Norwood, Mass. The model AD9830 DDS includes two 32 bit-wide input registers FREQ0 and FREQ1 for storing integer numerical values of angular data, $\Delta\phi$. The 32 bit-wide $\Delta\phi$ angular data is formed by combining the 16 bit-wide frequency control signals generated by ROM1 412 and ROM2 414. In order to load the 16 bit wide frequency control signals into numerically controlled oscillator 416, a MSB/LSB signal is generated by the address counter 410 from the least significant bit of the address counter 410 and is applied to the A0 input of the numerically controlled oscillator 416. When the least significant bit of the address counter 410 is in a "zero" state, the ROM1 412 and ROM2 414 outputs are loaded into the 16 least significant bits of either the FREQ0 register or the FREQ1 register. When the output of the least significant bit of the address counter 416 is in a "one" state, the ROM1 412 and ROM2 414 outputs are loaded into the 16 most significant bits of either the FREQ0 register or the FREQ1 register. Thus, in each repetition interval, 1024, 32 bit-wide $\Delta\phi$ control words are formed in the numerically controlled oscillator 416. In the first preferred embodiment, the output frequency of the numerically controlled oscillator 416, $f_{out}$, is an integer multiple of an integer sub-multiple of the output frequency of the clock 400, $f_{clock}$, as expressed by equation (1):

$$f_{out} = \Delta\varphi \cdot \left[\frac{f_{clock}}{2^{32}}\right] \quad \text{(Eq. 1)}$$

In the first preferred embodiment, the numerically controlled oscillator 416 further includes a sine look up table for converting accumulated values of control words $\Delta\phi$, which vary in range from 0 to about $2\pi$ radians, to amplitude values corresponding to a sine function. Thus, the numerically controlled oscillator 416 generates an alternating electric signal in which the instantaneous amplitude varies substantially as a sine wave and the frequency varies in accordance with the frequency control signal. It will be appreciated by those skilled in the art that the output waveshape of the numerically controlled oscillator 416 need not be sinusoidal. Other signal waveshapes such as square or triangular may be generated by the numerically controlled oscillator 416 within the spirit and scope of the invention.

It will be appreciated by those skilled in the art that the numerically controlled oscillator 416 for generating an alternating electric signal output having a variable frequency is not limited to being a direct digital synthesizer. Other types of variable frequency oscillators, having the frequency of the output restricted to a sub-multiple of a substantially fixed clock frequency, such synthesizers, may be used as the numerically controlled oscillator 416without departing from the spirit and scope of the invention.

In the first preferred embodiment, the output of the numerically controlled oscillator 416 is filtered with a conventional low-pass filter (not shown). The low pass filter attenuates the high-frequency components of the output signal of the numerically controlled oscillator 416, converting the jagged numerically controlled oscillator 416 output waveform into a substantially smooth sine wave. The filtered output signal from the numerically controlled oscillator 416 is applied to a conventional pre-amplifier (not shown) which provides amplification and reverse isolation between the numerically controlled oscillator 416 and the antenna 16.

The first preferred embodiment further includes an antenna 16 comprising a coil of about five turns of wire wound on a form of about one-half inch diameter. The antenna 16 is both a transmitting antenna and a receiving antenna and is driven through an inductor having an inductance of about ten times the inductance of the antenna 16. When the tag 14 is placed within the measurement zone, the presence of the resonant circuit of the tag 14 causes a distinctive time varying voltage pattern to form across the antenna 16 as the frequency of the alternating electric signal applied to the antenna 16 through the series inductor is swept between the lowest frequency and the highest frequency by the numerically controlled oscillator 416.

Figure 2:
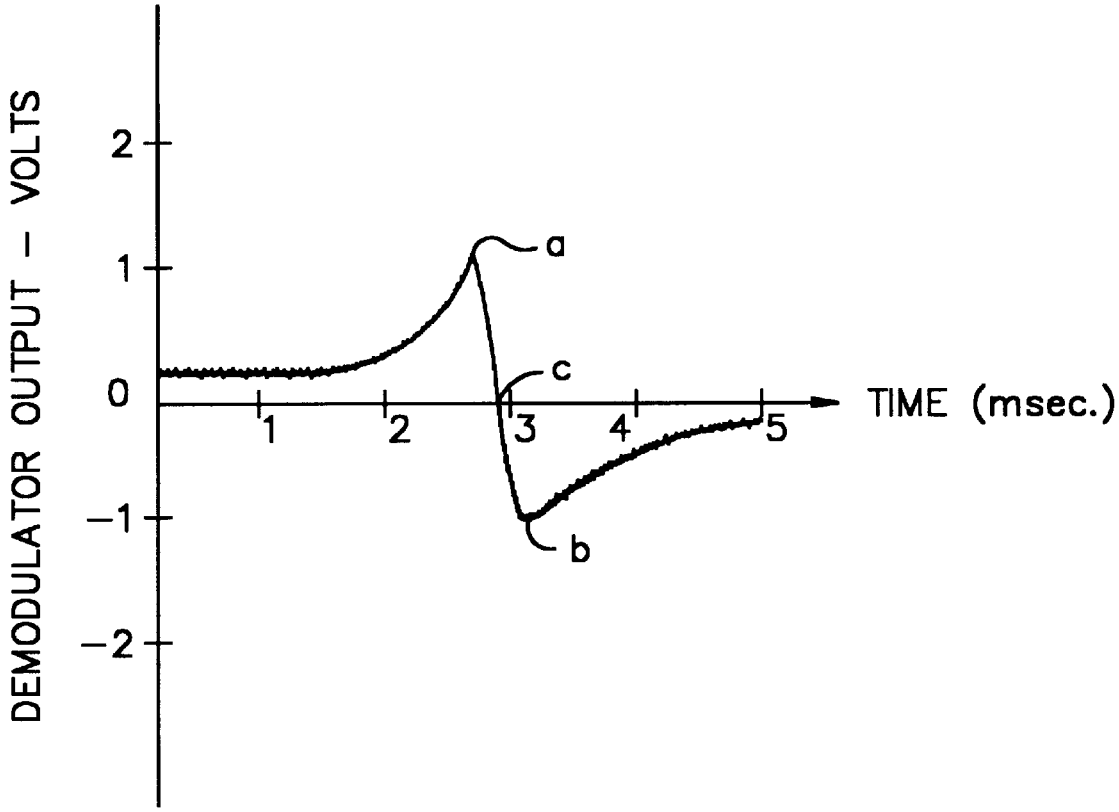
FIG. 2 is a plot of the demodulator output signal of the apparatus shown in FIG. 1.

In the first preferred embodiment, the voltage across the antenna 16 is applied to a receiver 18 comprising a demodulator 19 and a signal processor 20. Preferably, the demodulator 19 comprises a post-amplifier and an envelope detector (not shown) of types well known to those in the art. The post amplifier, connected to the antenna 16, amplifies the voltage across the antenna 16 to a voltage level suitable for application to the envelope detector. As shown in FIG. 2, when the voltage applied to the antenna 16 is swept from the lowest to the highest frequency and a security tag 14 having a resonant frequency within the sweep interval is within the measurement zone, the voltage at the output of the envelope detector is a characteristic "S" shaped response curve having positive and negative peaks a, b and a point of zero crossing c. In the preferred embodiment, the positive and negative peaks a, b are indicative of the 3 DB down points of the resonance characteristic of the tag 14 under test and the point of zero crossing c, is indicative of the center frequency of the resonance of the tag 14.

As will be appreciated by one skilled in the art the numerically controlled oscillator 416, as shown in FIG. 1, is not limited to generating a signal which varies linearly in frequency as described in the first embodiment. The numerically controlled oscillator 416 may be used to generate a repeating alternating electric signal pattern comprising a sequence of RF bursts at a plurality of distinct frequencies, the bursts of RF separated by quiescent periods of time. As will be appreciated by those skilled in the art, an arbitrary frequency pattern is easily achieved by storing the desired frequency pattern in ROM1 412 and ROM2 414. The bursts of RF are achieved by gating the output of the transmitter 12 on and off by a signal (not shown) generated from the PLA 406. The characteristics of the resonant security tag 14 may be measured by generating RF bursts of duration equal to or greater than the resonant circuit "Q" divided by the resonant frequency of the tag 14 (in radians per second). By activating the receiver 18 during each quiescent period and varying the frequency of the output of the NCO 416 over the expected range of the resonant frequency of the tag 14, the resonant frequency and "Q" of the tag 14 may be determined by measuring the amplitude of the output of the receiver 18 for each burst. Alternatively, the RF bursts may be made short compared to the "Q" divided by the resonant frequency of the tag 14. In this case, the characteristics of the tag 14 may be determined by performing a time domain to frequency domain transform of the pre-demodulated received signal during the quiescent periods.

In the first preferred embodiment the output of the demodulator 19 is provided to the signal processor 20 for measuring the characteristics of the resonant circuit and providing the measurement results to a user. Preferably the signal processor 20 includes an analog-to-digital converter for converting the envelope detector output signal into a digital representation. The signal processor 20 further includes a microprocessor for accepting the analog-to-digital converter output. Preferably, the microprocessor is a type commonly referred to as a digital signal processor (DSP) and includes supporting electronic circuitry arranged in a conventional configuration well known to those in the art. In the first preferred embodiment, the DSP is a TMS 320C50 digital signal processor manufactured by Texas Instruments, supported by a read only memory (ROM), a static random access memory (RAM), a serial interface device for interfacing to a conventional personal computer and a field programmable gate array (FPGA) for controlling the analog-to-digital converter and the serial interface device. A in the art, other microprocessor types and configurations could be used. Further, the allocation of amplification, demodulation and signal processing functions between the demodulator 19 and the signal processor 20 is arbitrary.

In use, the test system 10 is situated proximate to an automatic security tag 14 testing system in which resonant security tags 14 are rapidly moved past the antenna 16 in synchronization with the repetition interval of the electric current applied to the antenna 16. The signal processor 20 stores the envelope detector output signal for each repetition interval in the random access memory and correlates the envelope detector output signal with each respective tag 14. The processor 20 then determines the envelope detector output signal peak-to-peak amplitude, the frequencies of the positive going peak and the negative going peaks and the frequency where the signal intersects abscissa. The aforementioned information is used to estimate electrical characteristics such as the "Q" and resonant frequency of each tag 14. Preferably, the electrical characteristics are transmitted to an attached personal or other computer for segregating reject tags 14 from good tags 14 and for display of the measurement data to the automatic test system operator.

Figure 3:
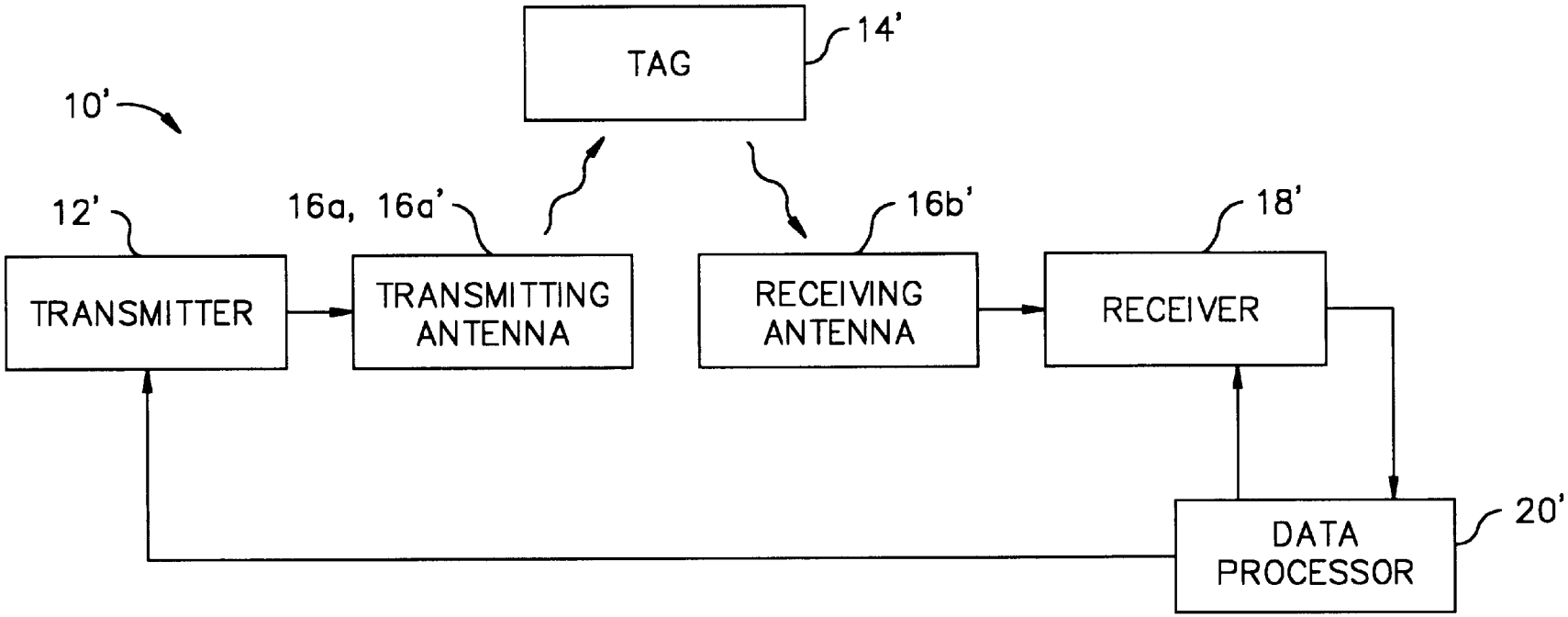
FIG. 3 is a functional block diagram of an apparatus for detecting the presence of a security tag and for deactivating a security tag in accordance with the second and third embodiments of the present invention.

Referring now to FIG. 3 there is shown an electronic article security (EAS) system 10' for detecting the presence of a resonant security tag 14' within a detection zone in accordance with a second embodiment. The second preferred embodiment incorporates an improved transmitter 12' in accordance with the present invention but otherwise generally constitutes the conventional components of an EAS system of the type manufactured and available from Checkpoint Systems, Inc. of Thorofare, N.J.

The second embodiment includes a previously described transmitter 12' comprising a previously described numerically controlled oscillator 416 (not shown) which generates an alternating electric signal, the frequency of which varies in accordance with a numerical frequency control signal and includes frequency components equal to the resonant frequency of a tag 14'. The apparatus 10' further includes a previously described clock 400 (not shown) having a substantially fixed frequency connected to the numerically controlled oscillator 416, the frequency of the first alternating electric signal being restricted to an integer multiple of an integer sub-multiple of the frequency of the clock 400. A transmitting antenna **16*a* is provided which emits electromagnetic energy in response to the alternating electric signal to establish an electromagnetic field within the detection zone. A receiving antenna 16*b* is provided for sensing disturbances in the electromagnetic field resulting from the presence of the tag 14' and for providing a signal to a receiver 18'. The receiver 18' operates to detect the disturbances in the electromagnetic field and to isolate the disturbances from the received alternating electric signal (carrier). The detected signals representative of the disturbance are provided to a data processor 20' to determine whether the detected disturbance is due to the presence of the tag 14'** or due to some other source.

Referring now to FIG. 1, the transmitter 12' of the second preferred embodiment includes the numerically controlled oscillator 416 for increasing the probability of detecting a tag 14 and for reducing the probability of false alarms due to spurious RF signals and other objects. In the second preferred embodiment, a clock 400, such as a crystal oscillator of a type well known to those skilled in the art, having a substantially fixed frequency of operation, is connected to the numerically controlled oscillator 416 such that the frequency of the output of the numerically controlled oscillator 416 is restricted to being an integer multiple of an integer sub-multiple of the frequency of the clock 400. Preferably, the numerically controlled oscillator 416 is a direct digital synthesizer having a phase accumulator and which provides an output signal having an instantaneous amplitude which is substantially sinusoidal.

The transmitter 12' of the second preferred embodiment also includes a frequency word generator comprising read only memories ROM1 412 and ROM2 414 for storing frequency control signal data. However, as will be appreciated by one skilled in the art, the frequency word generator could utilize different types of memory devices and could for instance also generate the frequency control signal in real time using a stored computer program executing in a computer or programmable logic array and still be within the sprit and scope of the invention.

The second preferred embodiment of the EAS system 10' employs the numerically controlled oscillator 416 to generate an alternating electric signal which varies in frequency in a substantially linear stepwise manner over a repetition interval. An EAS system typical of EAS systems employing a linear sweep transmitter signal and suitable for detecting the presence of a resonant security tag 14' is that described in U.S. Pat. No. 5,353,011 assigned to Checkpoint Systems, Inc. One skilled in the art will recognize that the transmitter 12' could be substituted for the VCO described in U.S. Pat. No. 5,353,011 to provide improved frequency stability and accuracy in the transmitter 12' output signal.

As will be appreciated by one skilled in the art the numerically controlled oscillator 416, may also be used to generate a repetitive alternating electric signal pattern comprising a sequence of RF bursts at a plurality of distinct frequencies, the bursts of RF separated in time by quiescent periods, as previously described for the first preferred embodiment. An EAS system typical of "pulse-listen" EAS systems transmitting bursts of RF separated by quiescent periods in which the receiver is actuated during the quiescent periods is described in U.S. Pat. No. 4,609,911 assigned to the Minnesota Mining and Manufacturing Co. As will be appreciated by those skilled in the art, the transmitter 12' could be substituted for the VCO described in U.S. Pat. No. 4,609,911 to provide improved frequency stability and accuracy of the output signal of the transmitter 12'.

Referring now to FIG. 3 there is shown an apparatus 10' for deactivating a security tag 14' according to a third embodiment of the present invention. The third embodiment includes a previously described transmitter 12' comprising a previously described numerically controlled oscillator 416 (not shown) which generates a first alternating electric signal, the frequency of which varies in accordance with a numerical frequency control signal and includes frequency components equal to the resonant frequency of the security tag 14'. The apparatus 10' further includes a previously described clock 400 (not shown) having a substantially fixed frequency connected to the numerically controlled oscillator 416, the frequency of the first alternating electric signal being restricted to an integer multiple of an integer sub-multiple of the frequency of the clock 400. The transmitter 12' also includes a transmitting antenna **16*a*' connected to the numerically controlled oscillator 416 for receiving the first alternating electric signal and establishing a first electromagnetic field within the deactivation zone wherein the first electromagnetic field interacts with the security tag 14' to deactivate the security tag 14'**.

In use, the deactivation apparatus 10' as described above employs a transmitter 12' and antenna **16*a*' capable of generating sufficient energy to cause one or more of the security tag 14' components to either short circuit or open circuit when exposed to the first electromagnetic field. The means for amplifying the numerically controlled oscillator 416 output signal to provide the required electromagnetic field energy for deactivation are well known to those skilled in the art of EAS systems and need not be described here. As known to those skilled in the art the deactivation apparatus 10'** may be actuated either manually or automatically from external sensors to generate the first electromagnetic field.

The deactivation apparatus 10' may further generate a second alternating electric signal to establish a second electromagnetic field, the apparatus 10' further including a receiving antenna **16*b*' for sensing disturbances in the second electromagnetic field and a receiver 18' for receiving signals from the receiving antenna 16*b*' representative of disturbances to the second electromagnetic field and for determining the presence of a security tag 14' in the deactivation zone. Upon determining the presence of the security tag 14' within the deactivation zone and also the resonant frequency of the security tag 14', the first electromagnetic field is established at the resonant frequency of the tag 14', to interact with the security tag 14' and to thereby deactivate the security tag 14' as described above. As will be recognized by those skilled in the art, the deactivation apparatus 10' may detect the presence of the security tag 14'** in the deactivation zone by either: (1) the previously described sweep frequency technique wherein the second alternating signal varies upwardly or downwardly in a substantially linear manner over a repetition interval or (2) the previously described pulse-listen technique wherein the second alternating electric signal comprises a sequence of a plurality of distinct frequencies separated by quiescent periods of time.

It will be appreciated by those skilled in the art that changes could be made to the embodiments described above without departing from the broad inventive concept thereof It is understood, therefore, that this invention is not limited to the particular embodiments disclosed, but it is intended to cover modifications within the spirit and scope of the present invention as defined by the appended claims.

I claim:

1. An apparatus for measuring electrical characteristics of a resonant circuit without physically contacting the resonant circuit comprising:

a numerically controlled oscillator for generating an alternating electric signal, the frequency of the alternating electric signal varying in accordance with a numerical frequency control signal;

a transmitting antenna connected to the numerically controlled oscillator for establishing an electromagnetic field within a measurement zone;

a receiving antenna for sensing disturbances to the electromagnetic field due to a presence of the resonant circuit within the measurement zone;

a receiver for receiving signals from the receiving antenna representative of the disturbances to the electromagnetic field and for determining a Q and a center frequency of the resonant circuit; and a clock having a substantially fixed frequency connected to the numerically controlled oscillator for providing a frequency reference to the numerically controlled oscillator, wherein the frequency of the alternating electric signal is restricted to being an integer multiple of an integer sub-multiple of the clock frequency.

2. An apparatus according to claim 1 wherein the numerically controlled oscillator is a direct digital synthesizer having a phase accumulator.

3. The apparatus according to claim 2 further including a frequency word generator for generating the numerical frequency control signal.

4. An apparatus according to claim 1 wherein the instantaneous amplitude of the alternating electric signal is substantially sinusoidal.

5. The apparatus according to claim 1 further including a frequency word generator for generating the numerical frequency control signal.

6. The apparatus according to claim 5 wherein the frequency word generator comprises a read only memory.

7. The apparatus according to claim 5 wherein the frequency word generator comprises a computer.

8. The apparatus according to claim 1 wherein the frequency of the alternating electric signal varies at least one of upwardly and downwardly in a substantially linear stepwise manner over a repetition interval.

9. The apparatus according to claim 1 wherein the alternating electric signal comprises a sequence of a plurality of distinct frequencies separated by quiescent periods of time.

10. An electronic article security (EAS) system for detecting the presence of a security tag in a detection zone comprising:

a numerically controlled oscillator for generating an alternating electric signal, the frequency of the alternating electric signal varying in accordance with a numerical frequency control signal;

a transmitting antenna connected to the numerically controlled oscillator for establishing an electromagnetic field within the detection zone;

a receiving antenna for sensing disturbances to the electromagnetic field due to a presence of the security tag within the detection zone;

a receiver for receiving signals from the receiving antenna representative of the disturbances to the electromagnetic field and for determining the presence of the security tag within the detection zone; and a clock having a substantially fixed frequency connected to the numerically controlled oscillator for providing a frequency reference to the numerically controlled oscillator, wherein the frequency of the alternating electric signal is restricted to being an integer multiple of an integer sub-multiple of the clock frequency.

11. An electronic article security (EAS) system according to claim 10 wherein the numerically controlled oscillator is a direct digital synthesizer having a phase accumulator.

12. The electronic article security (EAS) system according to claim 11 further including a frequency word generator for generating the numerical frequency control signal.

13. An electronic article security (EAS) system according to claim 10 wherein the instantaneous amplitude of the alternating electric signal is substantially sinusoidal.

14. The electronic article security (EAS) system according to claim 10 further including a frequency word generator for generating the numerical frequency control signal.

15. The electronic article security (EAS) system according to claim 14 wherein the frequency word generator comprises a read only memory.

16. The electronic article security (EAS) system according to claim 14 wherein the frequency word generator comprises a computer.

17. The electronic article security (EAS) system according to claim 10 wherein the frequency of the alternating electric signal varies at least one of upwardly and downwardly in a substantially linear stepwise manner over a repetition interval.

18. The electronic article security (EAS) system according to claim 10 wherein the alternating electric signal comprises a sequence of a plurality of distinct frequencies, separated by quiescent periods of time.

* * * * *